US011840864B2

(12) United States Patent
Huang

(10) Patent No.: US 11,840,864 B2
(45) Date of Patent: Dec. 12, 2023

(54) ELECTROMAGNETIC DRAWER LOCK SYSTEM AND METHOD

(71) Applicant: Zhenwu Huang, Las Vegas, NV (US)

(72) Inventor: Zhenwu Huang, Las Vegas, NV (US)

( * ) Notice: Subject to any disclaimer, the term of this patent is extended or adjusted under 35 U.S.C. 154(b) by 62 days.

(21) Appl. No.: 17/662,966

(22) Filed: May 11, 2022

(65) Prior Publication Data

US 2023/0366237 A1 Nov. 16, 2023

(51) Int. Cl.
*E05B 17/00* (2006.01)
*E05B 47/04* (2006.01)
(Continued)

(52) U.S. Cl.
CPC ..... *E05B 47/0003* (2013.01); *E05B 65/46* (2013.01); *G07C 9/00563* (2013.01); *G07C 9/00944* (2013.01)

(58) Field of Classification Search
CPC ..... Y10T 70/7068; G06V 40/13; E05G 1/005; E05G 1/04; E05C 19/166; B64U 2101/60; B64D 9/00; B64C 39/024; A63B 21/00065; A63B 21/00069; A63B 21/023; A63B 21/0421; A63B 21/0442; A63B 21/16; A63B 21/4031; A63B 21/4034; A63B 21/4047; A63B 2208/0233; A63B 23/03525; A63B 23/03541; A63B 23/0429; B60P 1/4435; B60P 1/4442; B60P 1/4457; B60P 1/4485; A47G 2029/1257; A47G 29/124; A47G 29/141; A47G 29/20; A47B 2210/0037; A47B 88/437; A47B 88/463; A47B 88/477; G07C 9/00563; G07C 2009/00769; G07C 2009/00634; G07C 2009/00642; G07C 2209/08; G07C 9/00174; G07C 9/00309; G07C 9/00944; G07C 9/37; E05B 65/46; E05B 2047/0094; E05B 1/00; E05B 2047/0058; E05B 2047/0069; E05B 2047/0097; E05B 45/005; E05B 47/0003; E05B 47/02;
(Continued)

(56) References Cited

U.S. PATENT DOCUMENTS

2019/0003205 A1* 1/2019 Zastrow ..... E05B 65/52
2019/0213818 A1* 7/2019 Einberg ..... G07C 9/00563
(Continued)

*Primary Examiner* — Dionne Pendleton
(74) *Attorney, Agent, or Firm* — The Thornton Firm, LLC

(57) ABSTRACT

An electromagnetic drawer lock system includes a fingerprint sensor module assembly; an outer shell assembly having a front opening, four sides, and a backboard; a drawer having a front, a back, two sides, and a bottom; an electromagnetic lock assembly; a lock catch; a sliding plate; a mechanical lock assembly; a grooved pulley; and a spring paddle assembly. A method of operation includes a user placing a fingerprint on a fingerprint sensor, the sensor capturing a fingerprint image; storing the captured fingerprint image in memory; capturing subsequent fingerprint images; comparing subsequent fingerprint image to images stored in memory; disengaging the electromagnetic lock upon successful recognition of captured fingerprint image; and engaging electromagnetic lock upon successful recognition of captured fingerprint image. A mechanical lock assembly can be used to open and close the drawer if using the fingerprint sensor module assembly is unsuccessful.

20 Claims, 8 Drawing Sheets

(51) Int. Cl.
*E05B 47/00* (2006.01)
*E05B 65/46* (2017.01)
*G07C 9/00* (2020.01)

(58) Field of Classification Search
CPC .... E05B 47/023; E05B 47/06; E05B 47/0657; E05B 65/44; E05B 65/52; E05B 67/003; E05B 71/00
See application file for complete search history.

(56) References Cited

U.S. PATENT DOCUMENTS

| | | | | |
|---|---|---|---|---|
| 2020/0282893 | A1* | 9/2020 | Weinmeister | B60P 1/4442 |
| 2021/0259417 | A1* | 8/2021 | Cooper | E05B 47/023 |

* cited by examiner

ELECTROMAGNETIC DRAWER LOCK SYSTEM AND METHOD

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

The invention relates generally to the field of locking drawers. More specifically, the present invention relates to an improved drawer system including an electromagnetic locking mechanism with a fingerprint recognition system.

2. Description of the Related Art

Drawers are well known in the art. A drawer is a generally box-shaped container which slides out horizontally from a piece of furniture or fixture to access its contents. Drawers can be built into numerous types of furniture or fixtures including, but not limited to, cabinets, chests of drawers, nightstands, desks, tables, safe boxes, toolboxes, mantles and hearths.

A typical drawer includes a front face, two side pieces, a rear, and a bottom piece. Drawers are often designed so that the front face is complete and the end grain from the side pieces are not visible. Drawers can be fashioned by numerous means. In some designs, the corners of a drawer may be dovetailed for additional strength or for aesthetics, and a half-blind dovetail joint may be used for the front corners to hide such a joint. To attach the bottom piece of the drawer, a groove may be cut in the four vertical pieces to insert the bottom of the drawer.

Drawer locks have been available for centuries. Traditional drawer locks include cam locks and deadbolt locks. Cam locks require a key to turn a lock mechanism which is typically mounted in the center top of the front face. In a cam lock, a latching mechanism rotates into a locking position when actuated. In a deadbolt lock, a latching mechanism slides into a locking position when actuated. Both mechanisms, though simple and inexpensive, are highly prone to being picked or broken due to the lock mechanism's positioning in the front face of a drawer. Moreover, most drawer locking mechanisms are simple mechanisms which can be subjected to the hazards of lost keys, malfunctioning lock mechanisms, and Based on the foregoing, there is a need for an improved drawer lock system for both home and business use.

SUMMARY

The object of the present invention is to provide an improved locking drawer system and method for both home and business use. Such an improved locking drawer system and method is capable of providing easy access to the contents of a drawer while also proving greater security.

Embodiments of the invention include a fingerprint sensor module assembly; an outer shell assembly having a front opening, four sides, and a backboard; a drawer assembly having a front, a back, two sides, and a bottom; an electromagnetic lock assembly; a lock catch; a sliding plate assembly; a mechanical lock assembly; a grooved pulley; and a spring paddle assembly. The fingerprint sensor module, the electromagnetic lock assembly, the sliding plate and spring paddle assembly are mounted to the inner backboard of the outer shell assembly. The lock catch is mounted to the outer side of the back of the drawer.

In embodiments of the invention, the fingerprint sensor can be positioned on the front face of the drawer, or anywhere near the drawer system, while the remaining components of the fingerprint sensor module are located on the inner side of the backboard of the outer shell. The electromagnetic lock is positioned on the sliding plate. The sliding tracks of the drawer are located on the inner sidewalls of the outer shell. The lock catch is at the back end of the drawer. The sliding plate is on the backboard of outer shell, slid and fixed by the small pulley. The mechanical lock is connected with the shell of the outer shell and the grooved pulley is at the end of the lock. the grooved pulley was connected to the sliding plate by the rotatable rivet; the spring paddle is on the baseplate of the outer shell and close to the back of the drawer.

A method of operation includes a user placing a fingerprint on a fingerprint sensor, the sensor capturing a fingerprint image; storing the captured fingerprint image in memory; capturing subsequent fingerprint images; comparing subsequent fingerprint image to images stored in memory; disengaging the electromagnetic lock upon successful recognition of captured fingerprint image; and engaging electromagnetic lock upon successful recognition of captured fingerprint image.

The invention is structurally simple and is designed to provide a cost-effective means of securing drawers for both residential and commercial applications alike. The electromagnetic drawer system can be locked and unlocked easily by simply placing a thumb or finger on a sensor. Such a system and method is easier to operate and is substantially more secure than traditional locking mechanisms.

BRIEF DESCRIPTION OF THE DRAWINGS

The invention directed by way of example, and not by way of limitation, in the figures of the accompanying drawings and in which like reference numerals refer to similar elements and in which.

Figure 1:
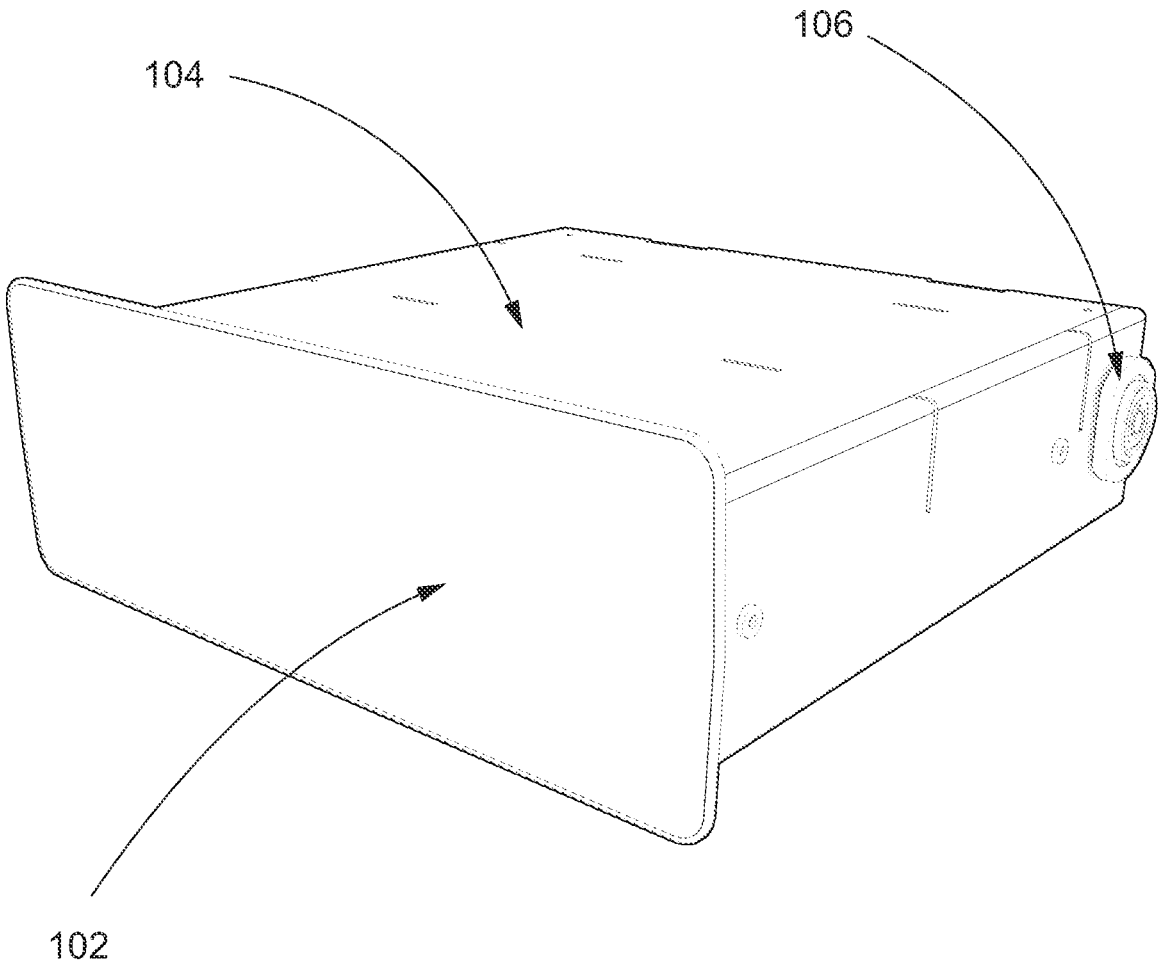
FIG. 1 illustrates perspective view of a drawer having an electromagnetic drawer lock system in accordance with an embodiment of the invention.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "one variant," "an embodiment," "a variant," "various embodiments," "numerous variants," etc., may indicate that the embodiment(s) of the invention so described may include particular features, structures, or characteristics. However, not every embodiment or variant necessarily includes the particular features, structures, or characteristics. Further, repeated use of the phrase "in one embodiment," or "in an exemplary embodiment," or "a variant," or "another variant," do not necessarily refer to the same embodiment although they may. A description of an embodiment with several components in communication with each other does not imply that all such components are required. On the contrary, a variety of optional components are described to illustrate the wide variety of possible embodiments and/or variants of the present invention.

When a single device or article is described herein, it will be readily apparent to persons having skill in the art that more than one device or article or/machine (whether or not they cooperate) may be used in place of a single device or article or machine. Similarly, where more than one device or article or machine is described herein (whether or not they cooperate), it will be readily apparent that a single device/article may be used in place of the more than one device or article. Likewise, the functionality and/or the features of a device or article or machine may be alternatively embodied by one or more other devices or articles or machines which are not explicitly described as having such functionality and/or features. Thus, other embodiments of the present invention need not include a specific device in and of itself.

A "computer" may refer to one or more apparatus and/or one or more systems that are capable of accepting a structured input, processing the structured input according to prescribed rules, and producing results of the processing as output. Examples of a computer may include: a personal computer (PC); a stationary and/or portable computer; a computer having a single processor, a computer having multiple processors, or a computer having multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer; a personal digital assistant (PDA); a portable telephone; a portable smartphone; wearable devices such as smartwatches; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

The term "processor" may refer to any device or portion of a device that processes electronic data from registers and/or memory to transform that electronic data into other electronic data that may be stored in registers and/or memory. A "computing platform" may comprise one or more processors.

A "microcontroller" generally refers to a small computer on a single integrated circuit. A microcontroller contains one or more central processing units (processor cores) along with memory and programmable input/output peripherals. A typical microcontroller includes a processor, memory and input/output (I/O) peripherals on a single chip.

An "algorithm" is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

It will be readily understood by persons skilled in the art that the various methods and algorithms described herein may be implemented by appropriately programmed computers, microcontrollers and computing devices. Typically, a processor (e.g., a microprocessor) will receive instructions from a memory or like device, and execute those instructions, thereby performing a process defined by those instructions. Further, programs that implement such methods and algorithms may be stored and transmitted using a variety of known media.

"Software" may refer to prescribed rules and/or instructions used to operate a computer. Non-limiting examples of software may include: Code segments in one or more computer-readable languages; graphical and or/textual instructions; applets; pre-compiled code; interpreted code; compiled code; and computer programs. An operating system or "OS" is software that manages computer hardware and software resources and provides common services for computer programs.

Certain embodiments described herein can be implemented in an operating environment comprising computer-executable instructions (e.g., software or firmware) installed on a computer, in hardware, or in a combination of software and hardware. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software program code for carrying out operations for aspects of the present invention can be written in any combination of one or more suitable programming languages, including an object-oriented programming languages and/or conventional procedural programming languages, and/or programming languages or other compilers, assemblers, interpreters or other computer languages or platforms.

A "computer system" may refer to a system having one or more computers, where each computer may include a computer-readable medium employing software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a plurality of computers and associated devices that may be connected by communication channels to facilitate communication and resource sharing. A network may involve permanent connections such as cables or temporary connections such as those made through telephone, cable, wireless or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include, but are not limited to, an internet, such as the Internet or World Wide Web; an intranet; a personal area network (PAN); near field communication (NFC); a local area network (LAN); a wide area network (WAN); a virtual private network (VPN); internet of things (IoT); and a combination of networks, such as an internet and an intranet.

Aspects of the exemplary electromagnetic drawer lock system and method will be described below with reference to flowchart illustrations and/or block diagrams of methods, steps, apparatus (systems) and computer program products according to embodiments of the invention. Persons skilled in the art will understand that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, microcontroller, or other programmable data processing apparatus to produce a machine, such that the instructions, which execute via the processor of the computer or other programmable data processing apparatus, create means for implementing the functions/acts specified in the flowchart and/or block diagram block or blocks.

The flowchart and block diagrams in the figures illustrate the architecture, functionality, and operation of possible implementations of systems, methods, and computer program products according to various embodiments of the exemplary system and method for product photography. It will become readily apparent to persons skilled in the art that each block in the flowchart or block diagrams may represent a module, segment, or portion of code, which comprises one or more executable instructions for implementing the specified logical function(s). It will also be readily apparent to persons skilled in the art that in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any practical order.

It will also be understood by persons skilled in the art that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

It will be readily understood by persons skilled in the art that the various methods and algorithms described herein may be implemented by appropriately programmed computers and computing devices. Typically, a processor (e.g., a microprocessor) will receive instructions from a memory or like device, and execute those instructions, thereby performing a process defined by those instructions. Further, programs that implement such methods and algorithms may be stored and transmitted using a variety of known media.

As is well known to those skilled in the art, many careful considerations and compromises typically must be made when designing the optimal manufacture or commercial implementation of such an electromagnetic drawer lock system and method. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

Systems will be described and provided with means and methods for providing and implementing an electromagnetic drawer lock system. The exemplary electromagnetic drawer lock system will now be described in detail with reference to embodiments thereof as illustrated in the accompanying drawings.

FIG. 1 illustrates perspective view of a drawer having an electromagnetic drawer lock system in accordance with an embodiment of the invention. In embodiments of the invention, the drawer having an electromagnetic drawer system includes a drawer assembly 102, an outer shell assembly 104, and a mechanical lock assembly 106.

Figure 2:
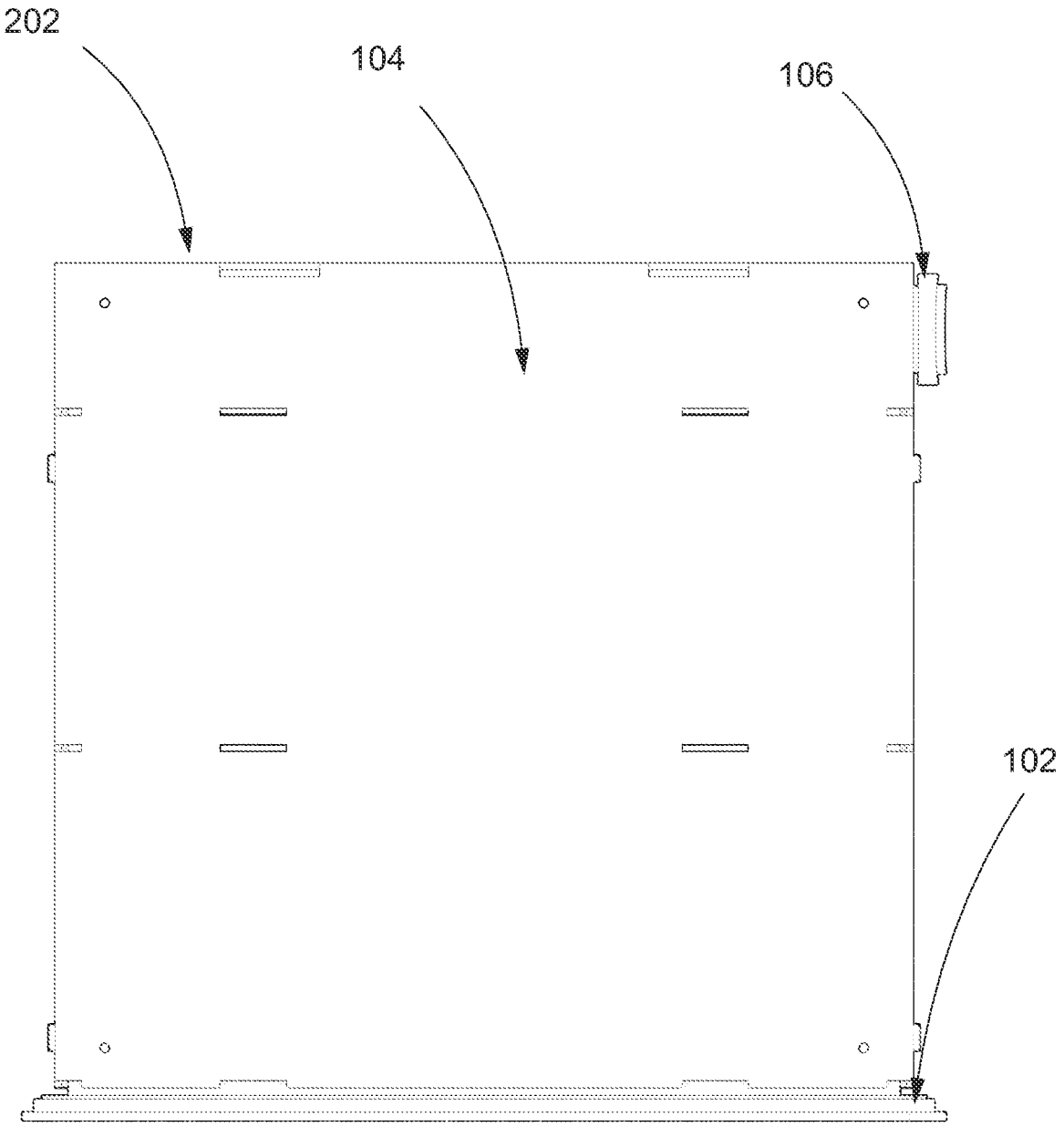
FIG. 2 illustrates a top sectional view of a drawer having an electromagnetic drawer lock system in accordance with an embodiment of the invention.

FIG. 2 illustrates a top plan view of a drawer having an electromagnetic drawer lock system in accordance with an embodiment of the invention. In embodiments of the invention, the drawer having an electromagnetic drawer system includes a drawer assembly 102, an outer shell assembly 104, and a mechanical lock assembly 106. The outer shell assembly 104 includes a top, a bottom, two sidewalls, and a backboard 202. Persons having skill in the art will understand that the top, bottom, two sidewalls, and backboard 202 have an outer surface and an inner surface, the outer surface shown and the inner surface being used to mount components to which a drawer will interface with the outer shell assembly 104.

Persons having skill in the art will appreciate that an outer shell assembly 104 can be made from numerous components such as, but not limited to, sheet metal, plastic or wood. An outer shell assembly 104 can be configured to mount in existing furniture as a retrofit kit or can be used to create new furniture or fixtures altogether. The inner surface of the backboard 202 of the outer shell assembly 104 serves as a mounting surface for the components of the electromagnetic drawer lock system and can serve to secure the outer shell assembly to furniture, cabinets or the like.

Figure 3:
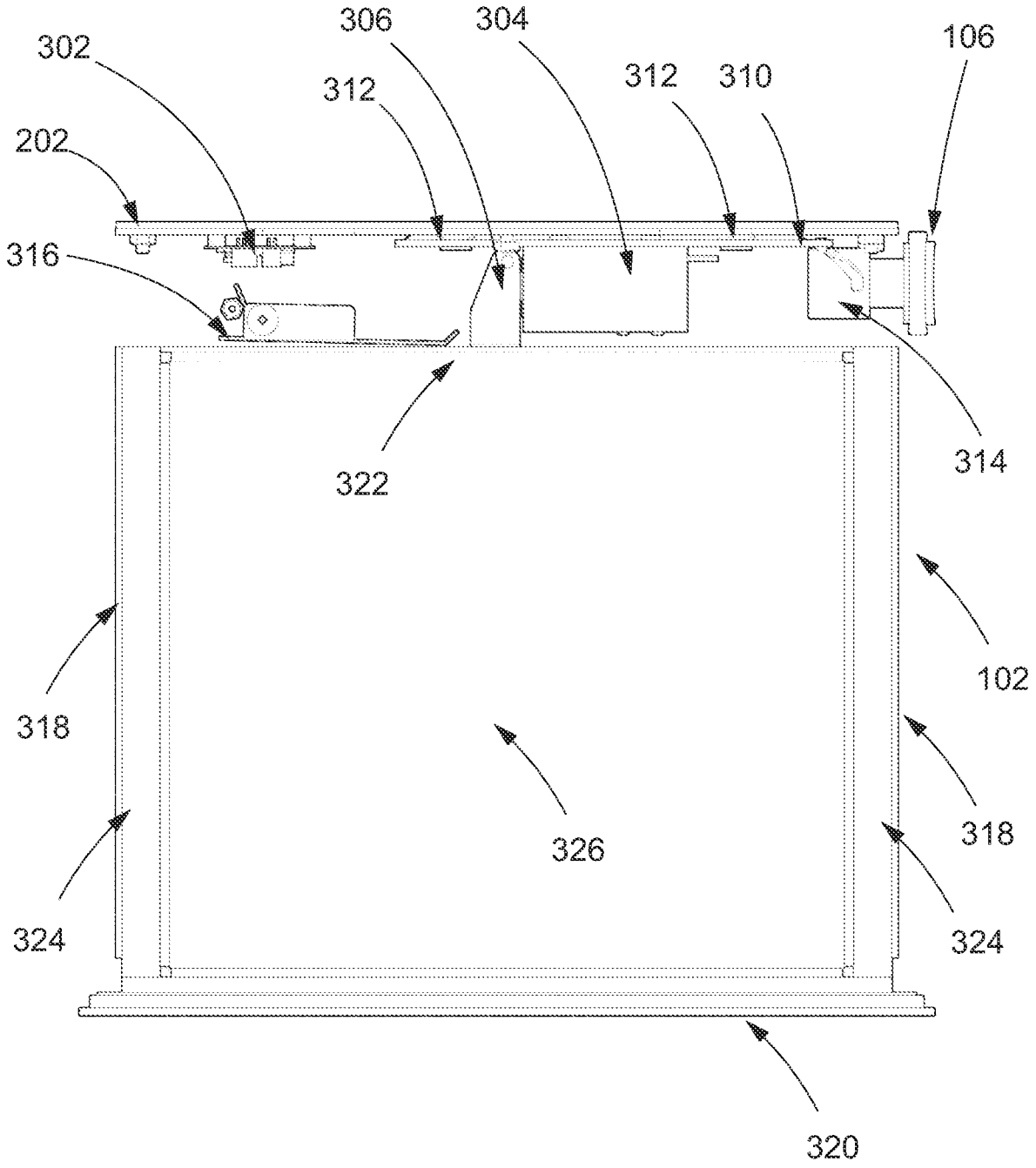
FIG. 3 illustrates a top sectional view of a drawer having an electromagnetic drawer lock system in accordance with an embodiment of the invention.

FIG. 3 illustrates a top sectional view of a drawer having an electromagnetic drawer lock system in accordance with an embodiment of the invention. In this figure, the electromagnetic lock mechanism is engaged. In an embodiment of the invention the fingerprint sensor module 302 is positioned on the backboard 202 of the outer shell assembly 104. The electromagnetic lock assembly is positioned on the sliding plate assembly 310. The lock catch 306 is mounted to the end of a drawer 102. The sliding plate 310 is fixed on the backboard 202 of the outer shell assembly 104 by the small pulley 312. A mechanical lock 106 is located outside the outer shell 104 with a grooved pulley 314 attached to the end of the lock. The grooved pulley 314 is connected to the sliding plate 310 by a rotatable rivet mechanism known and appreciated in the art. The spring paddle 316 is on the baseplate 202 of the outer shell 104 and is proximate to the back of the drawer assembly 102. The spring paddle 316 can be mounted to the backboard 202 of the outer shell facing the back of the drawer or can be mounted to the inner wall of the outer shell assembly 104, and is configured in such a manner so as to engage with the drawer assembly 102 and apply a force to the drawer so as to extend the drawer from the outer shell.

In embodiments of the invention, the drawer assembly 102 includes a front face 320, a back 322, two sides 324 and a bottom 326. In various embodiments of the invention, the drawer assembly movably couples with the outer shell assembly. In one embodiment of the invention, the drawer system employs mechanical slide rails 318, which consists of components such as, but not limited to, a chute, a ball, and a damping structure. A lock catch 306 is mounted to the outer side of the back of the drawer assembly 102. Persons having skill in the art will readily understand that the mechanical slide rails are mounted to outer surface of the two sides 324 of a drawer and the inner sidewalls of the outer shell assembly 104. The slide rails pair together such that drawer can removably connect with the pair of slide rails creating a functional drawer which moves in and out of the outer shell assembly 104. Persons skilled in the art will appreciate that numerous types of mechanical slide rails may be used.

In an embodiment of the invention, the fingerprint sensor module includes a fingerprint sensor module 302 which includes a fingerprint sensor and a printed circuit board module. The printed circuit board module assembly is attached to inner side of the backboard 202 of the outer shell assembly 104. In one embodiment of the invention, the fingerprint sensor is a capacitive fingerprint sensor and can be located anywhere on the system where a person can touch the sensor to lock or open the drawer system. Persons skilled in the art will appreciate that other types of sensors can be used such as, but not limited to, optical sensors and ultrasonic sensors. The sensor area is roughly 12 mm by 12 mm with a fingerprint capture image size of 160 by 160 pixels. The fingerprint image resolution is 508 dots per inch.

In embodiments of the invention, the printed circuit board module of the fingerprint sensor module 302 is divided into three parts: the main board, the power board, and the electromagnetic lock control board. The main board is connected with the fingerprint sensor, and is used to control the unlocking and closing of the drawer and store fingerprint information. The power board serves to provide power for the entire system, and to distribute power to the various components. The electromagnetic lock drive board serves as a power supply to electromagnetic lock and sends signals to the electromagnetic lock to engage the lock mechanism. The fingerprint sensor module includes at least one computer or processor with memory storage and reading ability to recognize at least ten fingers. In embodiments of the invention the fingerprint sensor module has at least one processor and memory including machine readable instructions that, when executed by the at least one processor, cause the fingerprint sensor module to perform the functions of capturing at least one fingerprint image; storing the said at least one fingerprint image in memory; capturing subsequent fingerprint images; comparing subsequent fingerprint image to images stored in memory; disengaging an electromagnetic lock and opening a drawer upon successful recognition of captured fingerprint image; and engaging an electromagnetic lock and locking a drawer upon successful recognition of captured fingerprint image. In various embodiments of the invention, the printed circuit board of the fingerprint sensor module can be networkable with other devices over a network such as, but not limited to, an intranet, the internet, the World Wide Web (WWW), the internet of things (IoT), a cellular telephone network, a telephone network, or any other network capable of enabling one device to communicate with another. Such a networked system is capable of being controlled via a software application installed in devices such as, but not limited to, a smartphone, tablet or personal computer.

In one embodiment of the invention, the overall working voltage of the product is 12V, 5A. The working voltage of the fingerprint module is 5V, 1A. The power board has a voltage conversion function, which converts 12V into 5A for the fingerprint module, and the working voltage of the electromagnetic lock is 12V, 2A. Persons skilled in the art will readily appreciate that power sources of all varieties can be employed and converted to 12V, 5A on the power board.

Figure 4:
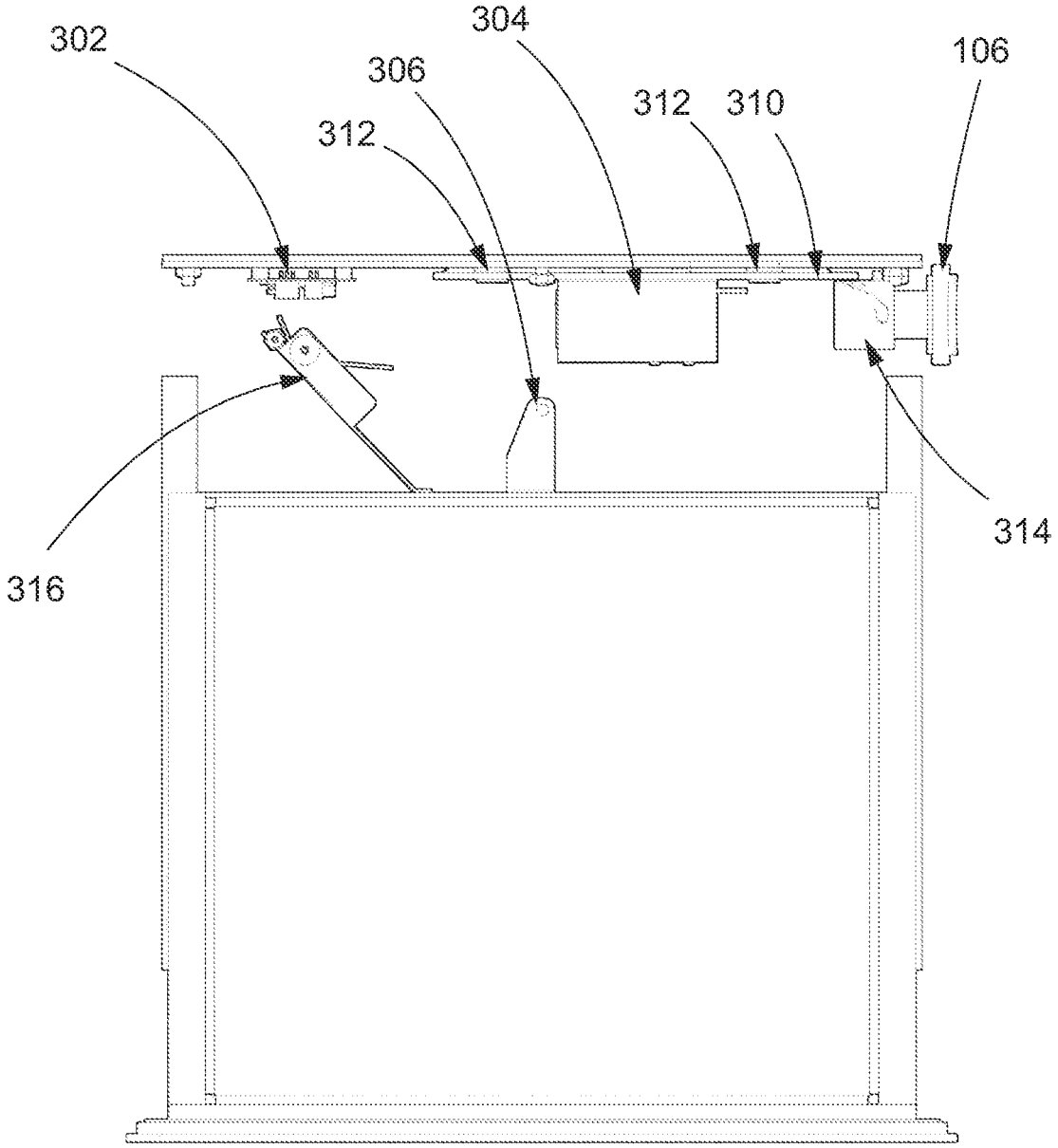
FIG. 4 illustrates a top sectional view of a drawer having an electromagnetic drawer lock system in accordance with an embodiment of the invention.

FIG. 4 illustrates a top sectional view of a drawer having an electromagnetic drawer lock system in accordance with an embodiment of the invention. In this figure, the electromagnetic lock mechanism is disengaged. In an embodiment of the invention the fingerprint sensor module 302 is positioned on the backboard of the outer shell 104; the electromagnetic lock assembly 304 is mounted on the sliding plate 310. The lock catch 306 is mounted on the outer side of the back end of the drawer assembly 102.

When the electromagnetic lock mechanism is engaged, the fingerprint sensor module 302 connects with the electromagnetic lock 304 and control of the electromagnetic lock 304 is performed through the use of a fingerprint sensor. When the fingerprint sensor module recognizes a matching fingerprint stored in memory, the fingerprint sensor module control panel will send a signal to the electromagnetic lock 304 to unlock the drawer. A latch mechanism of electromagnetic lock assembly 304 will move inside so that it will be separated from the lock catch 306 and the drawer will be unlocked. At that moment, the spring paddle 316 assembly will release a spring paddle to apply a force to the drawer 102. Such a force will move the drawer 102 out of the outer shell 104. A user may then move the drawer manually to access the contents therein.

A mechanical lock assembly 106 is mounted to a side of the outer shell assembly 104 and is configured to engage with a sliding plate 310 via a grooved pulley 314 in such a manner that when a key is turned, the said sliding plate 310 moves laterally along the backboard of the outer shell assembly. The sliding plate 310 is fixed on the backboard of the outer shell 104 by at least one small pulley 312. A mechanical lock 106 is located outside the outer shell and the grooved pulley 314 is at the end of the lock. A grooved pulley 314 is connected to the sliding plate 310 by a rotatable rivet mechanism known and appreciated in the art. The electromagnetic lock assembly 304 is mounted to the sliding plate 310 in such a manner that when the mechanical lock assembly 106 is engaged, the electromagnetic lock assembly 304 is moved in such a manner so as to disengage the electromagnetic lock assembly from the lock catch 306. A spring paddle assembly 316 can be positioned on the baseplate 202 in the outer shell 104 and proximate to the back of the drawer 102. In alternative embodiments of the invention, the spring paddle assembly 316, can be positioned in other locations such as the top inner surface of the outer shell assembly 104.

The spring paddle assembly 316 consists of a custom-made metal pick. The end of the metal pick has a connected central shaft and a V-shaped spring installed on the shaft. The spring paddle can be driven by a V-shaped spring to rotate around a rotating shaft, and the front end of the metal paddle is in contact with the tail of the drawer. When the drawer is unlocked, the paddle will push the drawer to make the drawer pop open. In one embodiment of the invention the spring consist of a 1 mm warp, 9 turns, 180 angle, and an 8 mm outer diameter.

Figure 5:
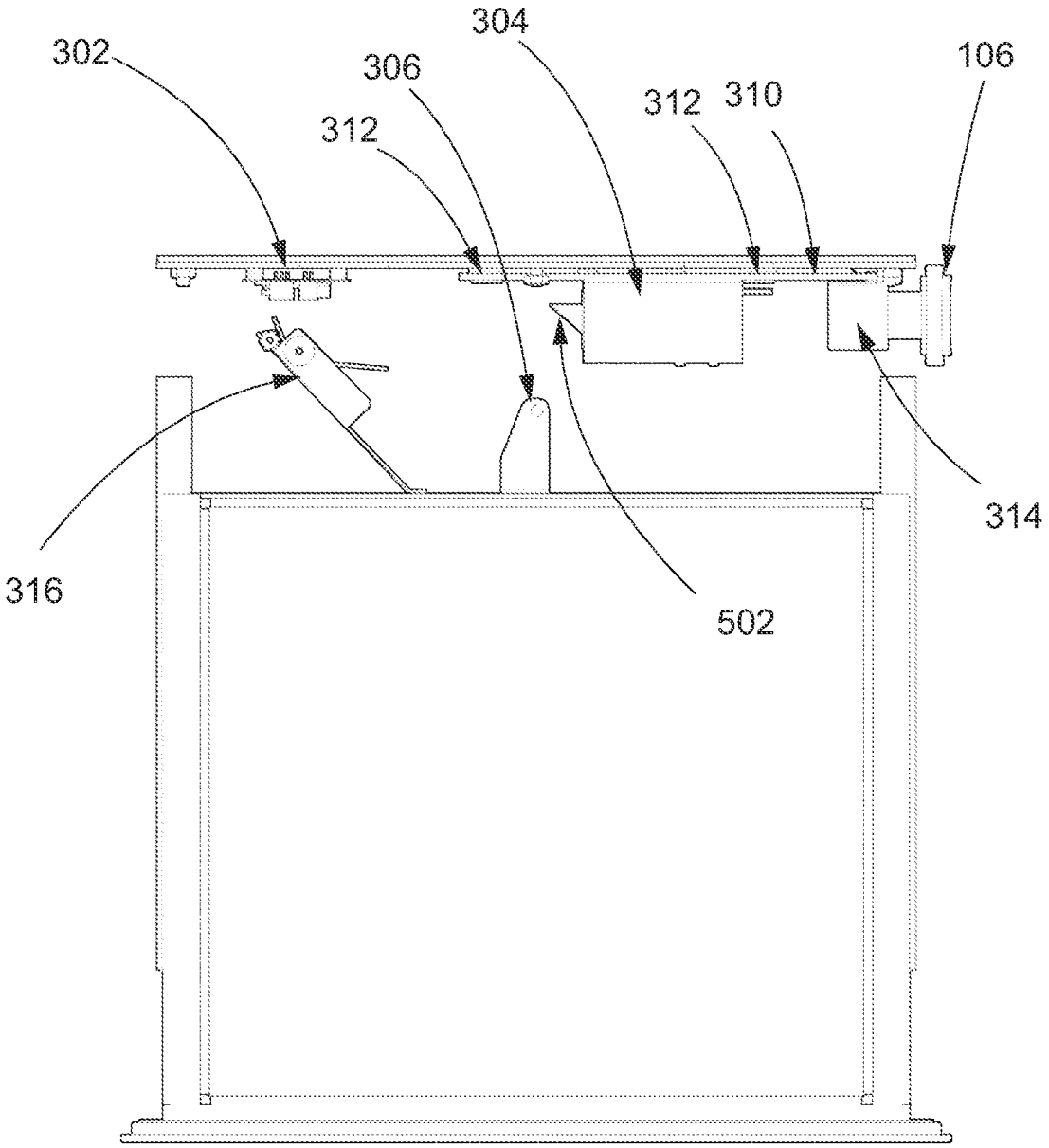
FIG. 5 illustrates a top sectional view of a drawer having an electromagnetic drawer lock system in accordance with an embodiment of the invention.

FIG. 5 illustrates a top sectional view of a drawer having an electromagnetic drawer lock system in accordance with an embodiment of the invention. In this view, the mechanical lock assembly has been engaged with the drawer open. The electromagnetic lock assembly has been disengaged from the lock catch. In embodiments of the invention, the mechanical lock 106 can be unlocked by a traditional key mechanism using various key types known and appreciated in the art. The electromagnetic lock 304 is mounted on the sliding plate 310. The lock catch 306 is at the end of the drawer 102. The sliding plate 310 is fixed on the backboard of the outer shell 104 by the small pulley 312. The mechanical lock 106 is connected with the outer shell 104 and the grooved pulley 314 is at the end of the lock; the grooved pulley 314 was connected to the sliding plate 310 by a rotatable rivet. The sliding plate 310 is fixed on the backboard of the outer shell 104 by the small pulley 312 and can slide horizontally. There is a rivet at the end of the sliding plate 310, and the rivet is embedded in the track of the groove pulley 314. When the mechanical lock 106 is turned by a key outside, the grooved pulley 314 will rotate as well and drive the sliding plate 310 to move to the electromagnetic lock assembly 302. The electromagnetic lock 302 is on the sliding plate 310, so it will move to the mechanical lock 106 as well so that the latch 502 of the electromagnetic lock assembly 302 will be separated from the lock catch 306 and the drawer will be unlocked.

There are two ways to unlock the drawer. Primarily, the fingerprint module is used to identify the user's fingerprint to drive the unlocking and release of the drawer. Another backup method is to unlock with the mechanical lock, which is used as an emergency solution when the fingerprint module does not work. The mechanical lock is arranged on the side of the outer shell. After being installed in combination with the cabinet carrier, a hole needs to be opened at the cabinet to expose the mechanical lock and to allow for mechanical unlocking. In one embodiment of the invention, the mechanical lock is a customized seven-star plum lock, and each lock and key are in one-to-one correspondence. Such a configuration provides a unique aesthetic and strong anti-theft capabilities.

Figure 6:
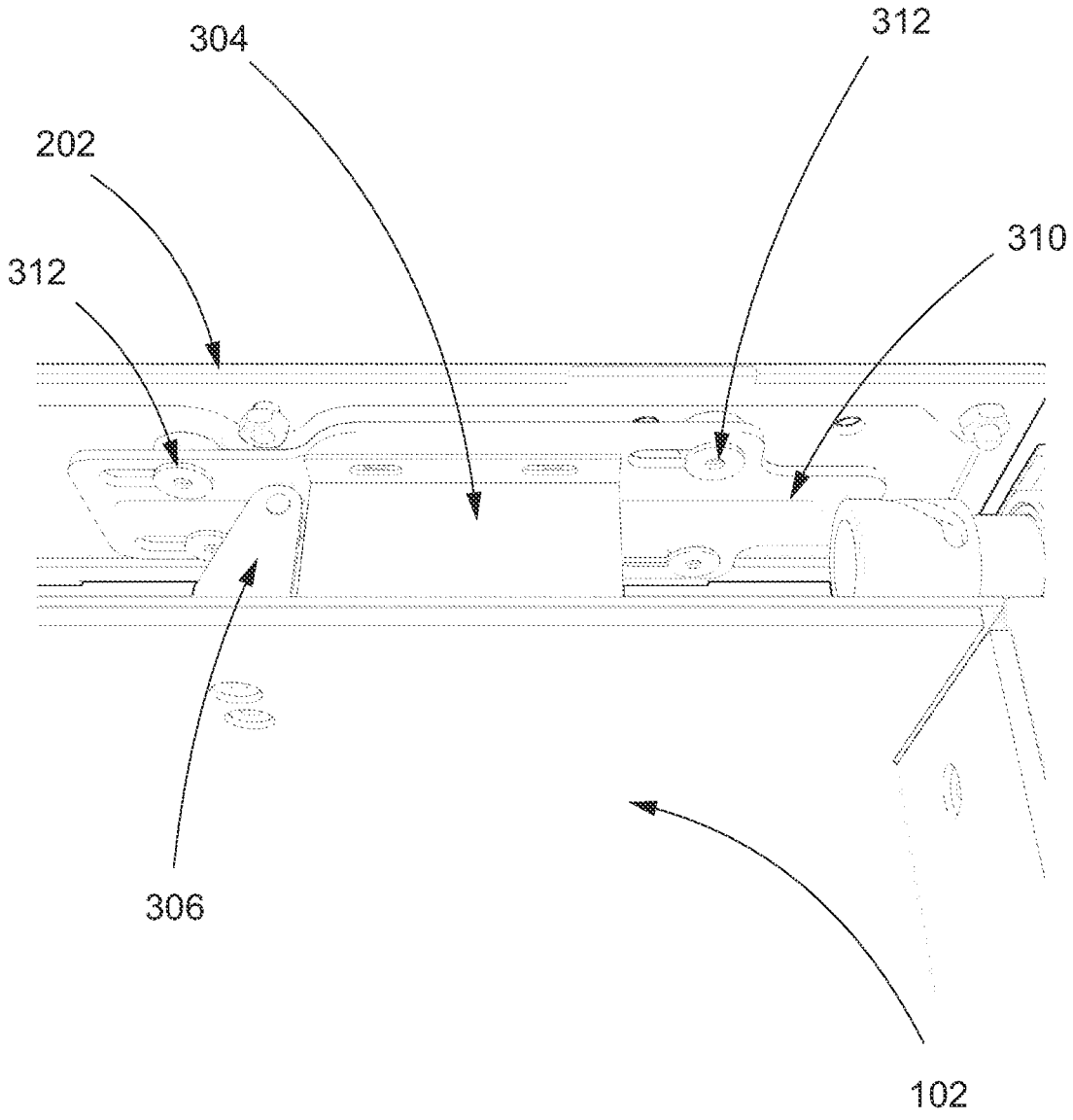
FIG. 6 illustrates a perspective view of an electromagnetic drawer lock system in accordance with an embodiment of the invention.

FIG. 6 illustrates a perspective sectional view of an electromagnetic drawer lock system in accordance with an embodiment of the invention. In this figure, the electromagnetic lock mechanism is engaged and the drawer is locked. In an embodiment of the invention, the electromagnetic lock assembly 304 is mounted on the sliding plate 310. The lock catch 306 is positioned at the back end of the drawer assembly 102. The sliding plate 310 is fixed on the backboard 202 of the outer shell 104 by the small pulley 312.

Figure 7:
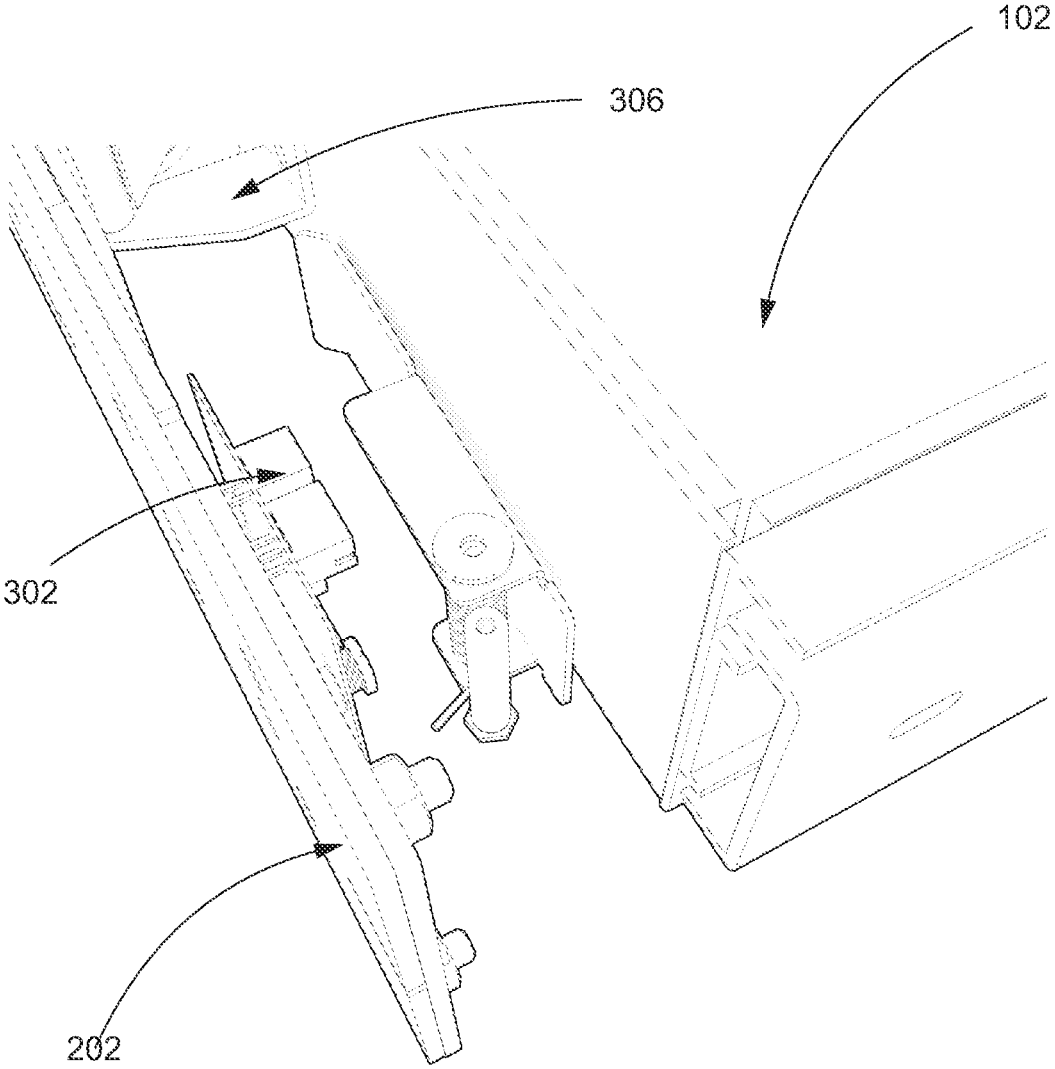
FIG. 7 illustrates a perspective sectional view of an electromagnetic drawer lock system in accordance with an embodiment of the invention.

FIG. 7 illustrates a perspective sectional view of an electromagnetic drawer lock system in accordance with an embodiment of the invention. When the drawer is locked, the spring paddle assembly 316 is on the baseplate 202 of the outer shell. When the drawer 102 is locked, the latch of the electromagnetic lock 302 is stuck in the lock catch 306. The spring paddle assembly 316 includes a spring paddle which is close to the back of the drawer with potential energy capable of ejecting the drawer 102. When the drawer 102 is unlocked, the spring paddle assembly 316 will eject and the counterforce will move the drawer 102 out of the outer shell 104.

Figure 8:
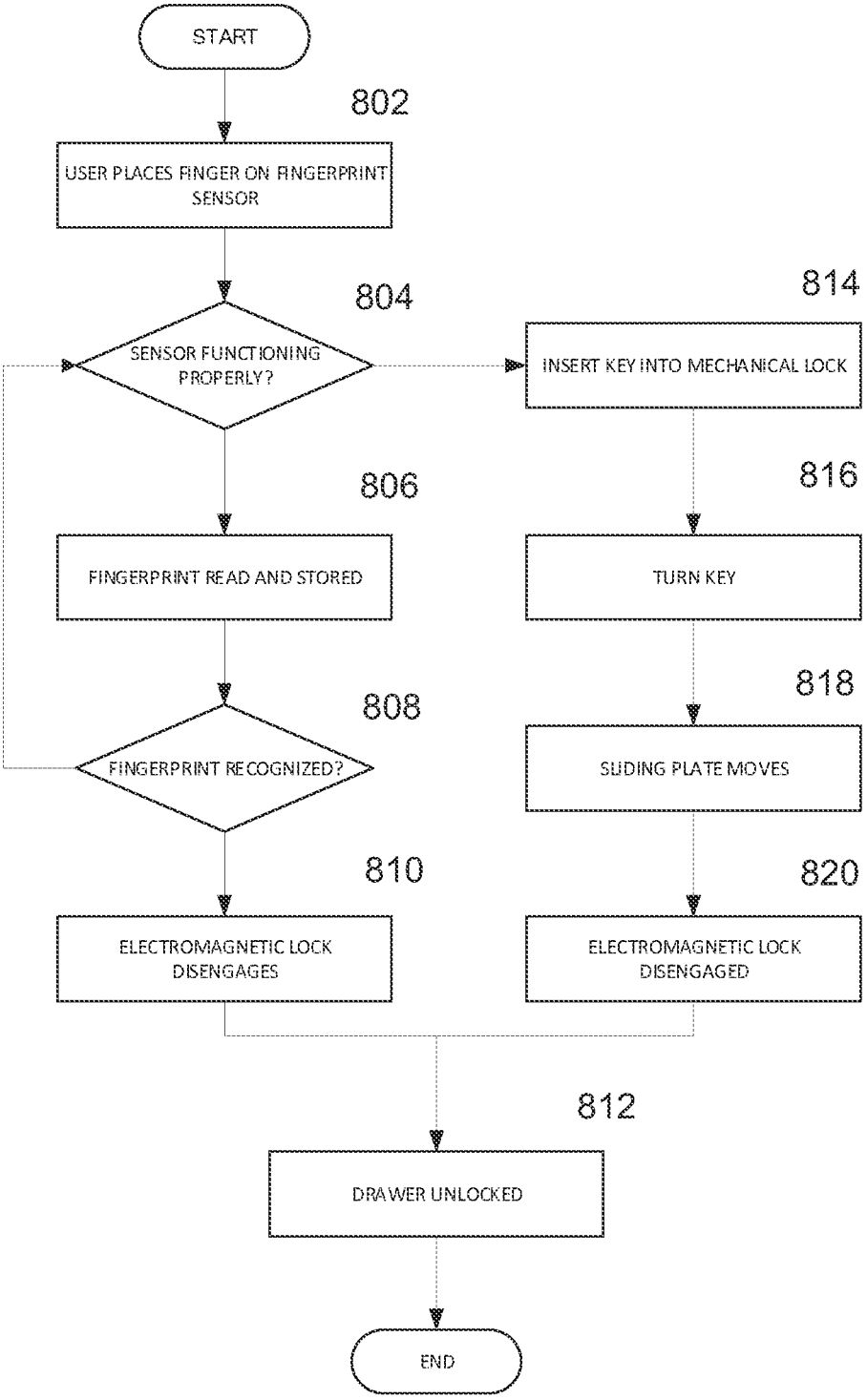
FIG. 8 illustrates a flowchart depicting a method for moving a drawer using an electromagnetic lock assembly.

FIG. 8 illustrates a flowchart depicting a method for securely storing valuables using an electromagnetic drawer lock, the drawer lock system comprising a fingerprint sensor module assembly; an outer shell assembly having a front opening, four sides, and a backboard; a drawer having a front, a back, two sides, and a bottom; an electromagnetic lock assembly; a lock catch; a sliding plate; a mechanical lock assembly; a grooved pulley; and a spring paddle assembly. The method comprises the steps of a user placing a finger on a fingerprint sensor 802, the fingerprint sensor module determining if the sensor is functioning properly through self-diagnostics known and appreciated in the art 804, the fingerprint image captured, read and stored into memory 806, the fingerprint image, if already stored in memory, being recognized by memory 808. If the fingerprint image is recognized, the electromagnetic lock disengages with the lock catch 810 and the drawer opens 810.

Another method includes a user placing a fingerprint on a fingerprint sensor 802, the sensor capturing a fingerprint image; storing the captured fingerprint image in memory; capturing subsequent fingerprint images; comparing subsequent fingerprint image to images stored in memory; disengaging the electromagnetic lock upon successful recognition of captured fingerprint image; and engaging electromagnetic lock upon successful recognition of captured fingerprint image. Persons having skill in the art will readily appreciate that such steps can be substituted or additional steps can be added to such an exemplary method.

If the fingerprint sensor does not work or if the fingerprint image captured, read and stored in memory is not recognized, a user can open a drawer using the mechanical lock. A user simply inserts a key into the mechanical lock 814 and turns the key 816. When the key is turned, the sliding plate moves and the electromagnetic lock mounted to the sliding plate is disengaged from the lock catch. The drawer is unlocked and the drawer opens 812.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the electromagnetic drawer lock system, other equivalent or alternative methods of implementing the electromagnetic drawer lock system according to the present invention will be apparent to those skilled in the art. Various aspects of the electromagnetic drawer lock system have been described above by way of illustration, and the specific embodiments disclosed are not intended to limit the invention to the particular forms disclosed. The particular implementation of the electromagnetic drawer lock system may vary depending upon the particular context or application. By way of example, and not limitation, the electromagnetic drawer lock system described in the foregoing was principally directed to furniture. However, similar techniques may instead be applied to other fixtures or furnishings which implementations of the present invention are contemplated as within the scope of the present invention. Additionally, differing combinations and arrangements of individual components may be implemented to achieve a more desirable appearance. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of electromagnetic drawer lock system are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively, and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims to be added at a later date.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. A method for securely storing valuables using an electromagnetic drawer lock system, the drawer lock system comprising:

a. a fingerprint sensor module assembly;
b. an outer shell assembly having a front opening, four sides, and a backboard;
c. a drawer having a front, a back, two sides, and a bottom;
d. an electromagnetic lock assembly;
e. a lock catch;
f. a sliding plate;
g. a mechanical lock assembly;
h. a grooved pulley; and
i. a spring paddle assembly;

the method comprising the steps of:

i. capturing a fingerprint image;
ii. storing said fingerprint image in memory;
iii. capturing subsequent fingerprint images;
iv. comparing subsequent fingerprint image to images stored in memory;
v. disengaging electromagnetic lock upon successful recognition of captured fingerprint image; and
vi. engaging electromagnetic lock upon successful recognition of captured fingerprint image.

2. The method of claim 1 further comprising the step of using the mechanical lock assembly to open and close the drawer if using the fingerprint sensor module assembly is unsuccessful.

3. An electromagnetic drawer lock system comprising:

a. a fingerprint sensor module assembly;
b. an outer shell assembly, said outer shell assembly having a front opening, four sides, and a backboard;
c. a drawer assembly, said drawer assembly having a front, a back, two sides, and a bottom;
d. an electromagnetic lock assembly;
e. a lock catch;
f. a mechanical lock assembly;
g. a grooved pulley;
h. a sliding plate; and
i. a spring paddle assembly.

4. The electromagnetic drawer lock system of claim 3 wherein the fingerprint sensor module assembly includes:

a. a fingerprint sensor; and
b. a printed circuit board module.

5. The electromagnetic drawer lock system of claim 4 wherein the printed circuit board module of the fingerprint sensor module assembly is attached to inner side of the backboard of the outer shell.

6. The electromagnetic drawer lock system of claim 3 wherein the lock catch is mounted to the outer side of the back of the drawer assembly, said lock catch configured to engage with the electromagnetic lock assembly.

7. The electromagnetic drawer lock system of claim 3 wherein the mechanical lock assembly is mounted to a side of the outer shell assembly and is configured to engage with the sliding plate via the grooved pulley in such a manner that when a key is turned, the said sliding plate moves laterally along the backboard of the outer shell assembly.

8. The electromagnetic drawer lock system of claim 3 wherein the electromagnetic lock assembly is mounted to the sliding plate in such a manner that when the mechanical lock assembly is engaged, the electromagnetic lock is moved in such a manner so as to disengage the electromagnetic lock assembly from the lock catch.

9. The electromagnetic drawer lock system of claim 3 wherein the drawer assembly movably couples with the outer shell assembly.

10. The electromagnetic drawer lock system of claim 3 wherein the spring paddle is mounted to the backboard of the outer shell facing the back of the drawer, and is configured in such a manner so as to engage with the drawer to extend the drawer from the outer shell.

11. The electromagnetic drawer lock system of claim 3 wherein the spring paddle assembly is attached to the backboard of the outer shell and engages with the back of the drawer assembly such that when a lock mechanism is disengaged with the lock catch, a spring paddle applies a force to the drawer assembly.

12. An electromagnetic drawer lock system comprising:

a. a fingerprint sensor module assembly, said fingerprint sensor module assembly including a fingerprint sensor and a printed circuit board module;
b. an outer shell assembly having a front opening, four sides, and a backboard;
c. a drawer assembly, said drawer assembly having a front face, a back, two sides, and a bottom;
d. an electromagnetic lock assembly;
e. a lock catch;
f. a sliding plate;
g. a mechanical lock assembly;
h. a grooved pulley; and
i. a spring paddle assembly.

13. The electromagnetic drawer lock system of claim 12 wherein the printed circuit board module of the fingerprint sensor module assembly is attached to inner side of the backboard of the outer shell.

14. The electromagnetic drawer lock system of claim 12 wherein the lock catch is mounted to the outer side of the back of the drawer, said lock catch configured to engage with the electromagnetic lock assembly.

15. The electromagnetic drawer lock system of claim 12 wherein the mechanical lock assembly is mounted to a side of the outer shell assembly and is configured to engage with the sliding plate via the grooved pulley in such a manner that when a key is turned, the said sliding plate moves laterally along the backboard of the outer shell assembly.

16. The electromagnetic drawer lock system of claim 12 wherein the electromagnetic lock assembly is mounted to the sliding plate in such a manner that when the mechanical lock assembly is engaged, the electromagnetic lock is moved in such a manner so as to disengage the electromagnetic lock assembly from the lock catch.

17. The electromagnetic drawer lock system of claim 12 wherein the drawer assembly movably couples with the outer shell assembly.

18. The electromagnetic drawer lock system of claim 12 wherein the spring paddle is mounted to the backboard of the outer shell facing the back of the drawer, and is configured in such a manner so as to engage with the drawer to extend the drawer from the outer shell.

19. The electromagnetic drawer lock system of claim 12 wherein the spring paddle assembly is attached to the backboard of the outer shell and engages with the back of the drawer assembly such that when a lock mechanism is disengaged with the lock catch, a spring paddle applies a force to the drawer assembly.

20. The electromagnetic drawer lock system of claim 12 wherein the fingerprint sensor module assembly includes at least one processor and memory, said memory including computer executable instructions which, when executed by the said at least one processor, cause the fingerprint sensor module assembly to perform the steps of:

a. capturing a fingerprint image;
b. storing said fingerprint image in memory;
c. capturing subsequent fingerprint image;
d. comparing subsequent fingerprint image to images stored in memory;
e. disengaging electromagnetic lock upon successful recognition of captured fingerprint image; and
f. engaging electromagnetic lock upon successful recognition of captured fingerprint image.

* * * * *